US008170256B2

(12) United States Patent
Enstad et al.

(10) Patent No.: US 8,170,256 B2
(45) Date of Patent: May 1, 2012

(54) MICROPHONE ASSEMBLY FOR MINIMIZING ACOUSTIC FEEDBACK FROM A LOUDSPEAKER

(75) Inventors: Gisle Enstad, Sandvika (NO); Tore Gravermoen, Kristiansand (NO); Johan Ludvig Nielsen, Oslo (NO)

(73) Assignee: Cisco Technology, Inc., San Jose, CA (US)

( * ) Notice: Subject to any disclaimer, the term of this patent is extended or adjusted under 35 U.S.C. 154(b) by 643 days.

(21) Appl. No.: 12/339,377

(22) Filed: Dec. 19, 2008

(65) Prior Publication Data

US 2009/0161900 A1 Jun. 25, 2009

(30) Foreign Application Priority Data

Dec. 21, 2007 (NO) ..... 20076609

(51) Int. Cl.
*H04R 9/08* (2006.01)

(52) U.S. Cl. ..... 381/357; 381/91; 381/93; 381/338; 381/355; 381/356; 381/360; 381/361

(58) Field of Classification Search ..... 381/338, 381/355–360, 91, 93, 361
See application file for complete search history.

(56) References Cited

U.S. PATENT DOCUMENTS

| | | | | |
|---|---|---|---|---|
| 3,715,500 | A | 2/1973 | Sessler et al. | |
| 4,463,222 | A | 7/1984 | Poradowski | |
| 4,555,598 | A | 11/1985 | Flanagan et al. | |
| 5,121,426 | A | 6/1992 | Baumhauer, Jr. et al. | |
| 5,627,901 | A | 5/1997 | Josephson et al. | |
| 6,434,248 | B1 * | 8/2002 | Juneau et al. | 381/322 |
| 6,597,793 | B1 | 7/2003 | Darbut et al. | |
| 7,916,885 | B2 * | 3/2011 | Nielson | 381/328 |

FOREIGN PATENT DOCUMENTS

| | | |
|---|---|---|
| DE | 44 39 146 A1 | 5/1996 |
| EP | 1 195 977 A2 | 4/2002 |
| JP | 45-25221 | 8/1970 |
| JP | 63-232798 | 9/1988 |
| JP | 4-217199 | 8/1992 |
| WO | WO 92/04792 | 3/1992 |
| WO | WO 99/37122 | 7/1999 |
| WO | WO 2007/126705 A2 | 11/2007 |

OTHER PUBLICATIONS

Office Action issued Nov. 29, 2010 in European Patent Application No. 08863800.2-2225.

Office Action issued Jan. 19, 2012 in Japanese Patent Application No. 2010-537883 filed Mar. 10, 2010 (English-language Translation Only).

* cited by examiner

*Primary Examiner* — Ramon Barrera
(74) *Attorney, Agent, or Firm* — Oblon, Spivak, McClelland, Maier & Neustadt, L.L.P.

(57) ABSTRACT

A microphone assembly for desktop communication systems utilizes a directional microphones in a desktop conferencing system without exposing the microphone to unfavorable mechanical or acoustic influence. The microphones is built into the front portion of the base of the system, in a mechanically controlled and robust way. The microphone assembly maximizes microphone sensitivity in the direction of a near end user while simultaneously minimizing microphone sensitivity in the direction of the loudspeaker.

15 Claims, 6 Drawing Sheets

MICROPHONE ASSEMBLY FOR MINIMIZING ACOUSTIC FEEDBACK FROM A LOUDSPEAKER

BACKGROUND

The disclosure relates to a microphone assembly of a loud speaking conference endpoint, more specifically, a microphone assembly is provided for minimizing acoustic feedback from a loudspeaker.

A conventional video conferencing endpoint includes a codec, a camera, a video display, a loudspeaker and a microphone, integrated in a chassis or a rack. In larger endpoints for use in meetings and boardrooms, the audio equipment is installed separately. The microphone is often placed on the meeting table to bring the audio recorder closer to the audio source in an acoustic sense.

However, personal video conferencing endpoints, also referred to as desktop terminals, are now becoming more common in offices as a substitute or supplement to larger endpoints or to traditional telephony. Personal equipment is more portable, and is likely to be placed close to the user on a table. Thus, all the equipment belonging to one endpoint, including the microphone is integrated in one device.

The microphone in a communication system should pick up voice from the user (called the near end user) with maximum quality and a suitable sensitivity. However, because a desktop system is relatively small, and all parts (including microphone and speaker) are integrated in one device, the microphone is positioned relatively close to the loudspeaker. This results in audio problems, as described below.

Desktop telecommunication terminals (video conferencing systems, IP-phones, or any loud speaking integrated communication system) with integrated loudspeaker(s) and microphone(s), for handsfree operation (loud speaking mode) experience an effect referred to as feedback. Feedback occurs when the sound from the loudspeaker of a terminal is received by the microphone of the same terminal. Feedback is highly unwanted in communication systems, for a number of reasons, as discussed below.

Feedback causes an echo in the communication (a loop back of sound) where the user hears a delayed version of his/her own voice. Echo in a communication system can be very disturbing, especially if the communication system includes large delays. The subjective degradation in communication quality caused by the echo depends on several factors, including the level of the echo, and the delay. FIG. 1 illustrates the fundamental echo problem of the background art.

Furthermore, feedback also restrains the maximum allowable output level on the loudspeaker, which may result in the near end user having difficulties hearing the far end user. As mentioned, desktop systems are often compact in size, and the loudspeaker is placed close to the microphone. Often the microphone is closer to the loudspeaker than the near end user. Hence, the sound level from the loudspeaker is often more powerful than the sound level (speech) from the near end user. If the sound level from the loudspeaker is too high, it may overload the microphone (acoustical overload) or the circuits (electrical overload), which leads to distortion of the microphone signal. Thus, the sound levels from the loudspeaker picked up by the microphone constrains the design of audio circuits, audio signal processing, and the allowed maximum level from the loudspeaker.

The loudspeaker signal can include far end talk and sounds generated by the near end system, e.g. key tones, ringing tones and so on. The loudspeaker signal is picked up by the microphone and transmitted to the far end. In general, the loudspeaker signal is unwanted in the microphone signal sent to the far end. The captured loudspeaker signal (referred to as echo) must be removed, or suppressed, from the microphone signal if the level and/or delay of the echo is large enough to cause significant disturbance in the communication. This is a well developed technology, and acoustic echo cancellation and/or echo suppression algorithms are incorporated in most digital IP based communication systems.

Therefore, the goal of the microphone and loudspeaker design of an integrated communication system with loud speaking hands-free mode is to allow for the best possible near end sound pick up (sound from near end user, e.g. speech), while simultaneously minimizing the acoustical feedback level from the loudspeaker(s) to the microphone(s). This allows for the best possible quality in the signal sent to the far end, and the level of the near end loudspeaker can also be maximized, to the benefit of the near end user. Echo cancellation and suppression algorithms will also benefit from minimal acoustical feedback from the loudspeaker to the microphone, and the risk of overloading the microphone and the audio circuitry is reduced. Digital signal processing is often used to ensure that the microphone and audio circuits are not overloaded by limiting the maximum loudspeaker signal.

Acoustical feedback can be reduced by increasing the distance from a loudspeaker to a microphone. However, the physical dimensions of the integrated system dictate the maximum distance. In addition, other considerations might require placing the microphone closer to the loudspeaker than the maximal possible distance. For example, to avoid comb filter effects caused by a table reflection of speech, the microphone needs to be placed very close to the table surface. This might not be the optimal placement with regards to acoustical feedback in an integrated desktop system.

Directional microphones can also be utilized to maximize microphone sensitivity in one or more directions, and minimize or reduce the sensitivity towards the loudspeaker, and as such, are commonly used in telephony and conferencing equipment. For example, the Polycom Soundstation™ series uses such microphones. However, the physical properties of directional microphone elements require that sound waves reach both the front and the rear of the microphone. Hence, the microphones are typically mounted in an open acoustical space of the product, typically beneath a perforated area or grill. This allows free flow of air past the microphone, but also requires a fragile mounting, and does not allow adjustments or optimization of the directional behavior of the microphone.

Further, directional microphones only effectively suppress sound when the sound source is directly behind the microphone. This is seldom the case in a desktop system.

The requirements for sound quality are increasing as communication systems are using higher bandwidth audio. Increasingly, acoustic echo and feedback controls are becoming critical issues for desktop systems. Microphone design, placement and assembly are therefore critical factors for the optimization of sound quality.

SUMMARY

The present disclosure employs a directional microphone element in a communication system in a way that maximizes microphone sensitivity in the direction of a near end user, while simultaneously minimizing the sensitivity in the direction of the integrated loudspeaker, to minimize feedback. The utilization of a directional microphone also reduces the ambient noise and reverberation pick-up.

More specifically, a desktop telecommunications terminal includes a loudspeaker and a directional microphone that has a front acoustical input port and a rear acoustical input port. The directional microphone is encapsulated in a housing. An acoustic waveguide is also disposed within the housing, and extends from the rear acoustical input port of the directional microphone to a waveguide inlet located on an upper surface of the desktop telecommunication terminal. The length and direction of the waive guide is tuned to simultaneously reduce an acoustic distance between the loudspeaker and the rear acoustical input port of the directional microphone, and to increase the acoustic distance between the user and the front acoustical input port of the microphone. A facing surface of the desktop telecommunication terminal includes at least one hole, and admits sound to the front acoustical input port of the microphone.

BRIEF DESCRIPTION OF THE DRAWINGS

A more complete appreciation of the inventions and many of the attendant advantages thereof will be readily obtained as the same becomes better understood by reference to the following detailed description when considered in connection with the accompanying drawings. However, the accompanying drawings and their exemplary depictions do not in any way limit the scope of the inventions embraced by this specification. The scope of the inventions embraced by the specification and drawings are defined by the words of the accompanying claims.

DETAILED DESCRIPTION

In the following, the present advancement will be discussed by describing a preferred embodiment, and by referring to the accompanying drawings. However, those skilled in the art will realize other applications and modifications within the scope of the invention as defined in the enclosed claims.

A microphone assembly for desktop telecommunication terminals is described herein. The exemplary assembly utilizes a directional electret condenser microphone element with a cardioid directivity pattern. The directional microphone has acoustical input ports at both a front and a rear of the element that, together with its internal design, gives the microphone a directional behavior. The directional behavior of the microphone is enhanced by guiding sound to the front and the rear sides of the microphone in a controlled way to maximize sensitivity in the direction of the near end user and minimize sensitivity in the direction of the integrated loudspeaker of a product. This is achieved by positioning the microphone at a front location of a base of a video conferencing terminal, in a mechanically controlled and robust way, using a tuned acoustical waveguide. The tuned acoustical waveguide is used to control the time delay between sound received at the front and the rear of the directional microphone, optimizing sound quality.

Figure 1:
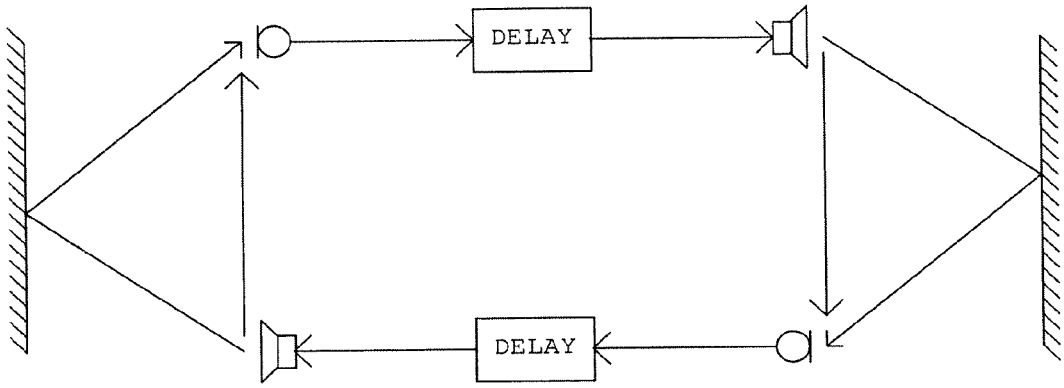
Figure 1 (Background Art)
FIG. 1 is a schematic diagram showing an echo relationship of a typical video conferencing arrangement.
Figure 2:
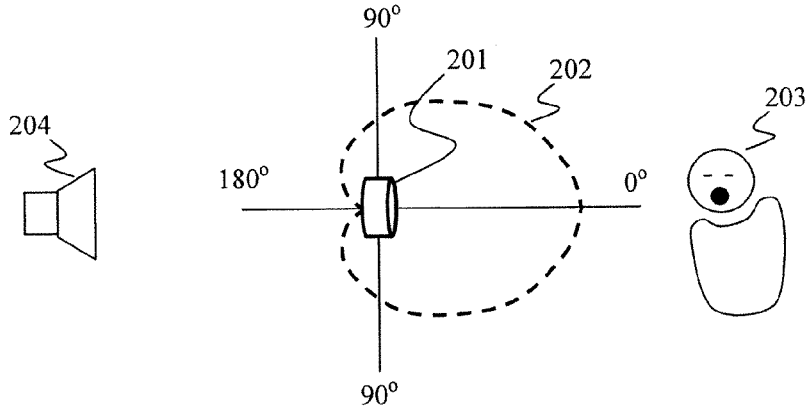
Figure 2 (Background Art)
FIG. 2 is a polar response of a typical unidirectional cardioid microphone element.

FIG. 2 shows a directional pattern 202 of a cardioid microphone 201. A cardioid microphone 201 is a directional microphone having a maximum sensitivity in the forward direction (0°), a minimum sensitivity in the backward direction (180°), and approximately half of the maximum sensitivity at 90°. This characteristic results from the geometry, internal design, and operating principle of the cardioid microphone element 201 as is known in the art.

Directional microphones have acoustical input ports at both their front and the rear sides. The acoustical input ports are separated by an effective distance "d" which represents the distance that a sound wave must travel around the directional microphone in going from one acoustical input port to the other. Movements of a diaphragm inside the microphone are converted into voltages at the output of the microphone. The magnitude of the voltage output of the directional microphone is a function of the instantaneous difference in sound pressure on the opposite sides of diaphragm. As distance "d" becomes smaller and smaller, so too does the output voltage from the directional microphone. Velocity of sound in air at room temperature is 1128 feet per second, so that a f=2250 Hz audible signal has a wavelength of about 15 cm. Thus, even small separation distances provide sufficient phase difference between the acoustical input ports so that the directional microphone has a polar response pattern 202 as shown in FIG. 2. Therefore, the sensitivity of the microphone 201 varies depending on the angle of incidence of sound waves. Forward sound incidence (sound from a sound source 203 located in front of the microphone at 0°) leads to a delay of the sound arriving at the rear acoustical input port of the microphone relative to the sound arriving at the front acoustical input port. Conversely, incidence from the rear side of the microphone element leads to a delay of the sound to the front input port relative to the sound arriving at the rear input port of the microphone 201.

Figure 3:
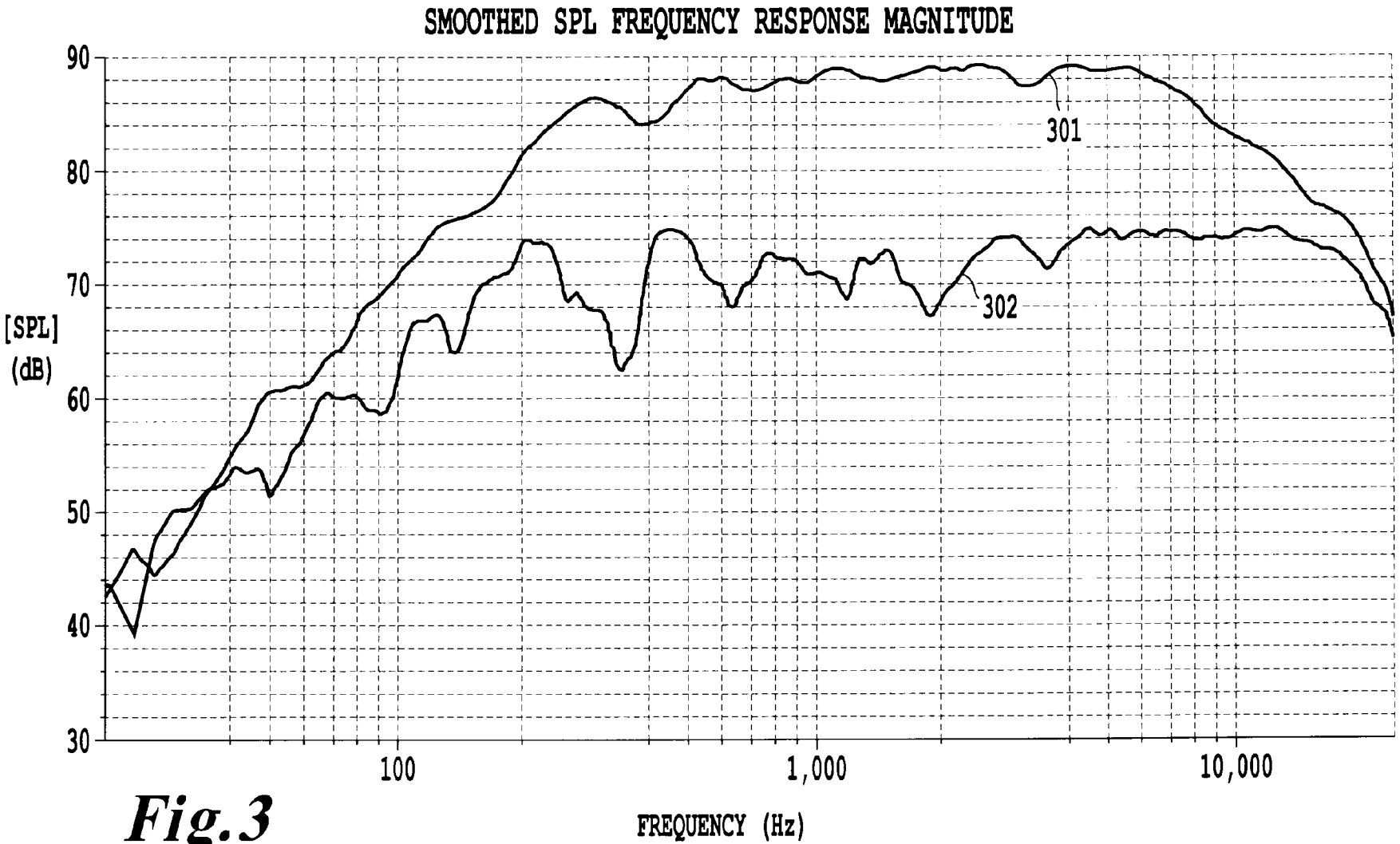
FIG. 3 is a plot of the free field response of a unidirectional microphone.

FIG. 3 shows a typical free field frequency response of a cardioid microphone, from front (0°) 301 and rear (180°) 302 sound incidence. As can be seen from the figure the frequency response of the sound signal incident at 0° is 15 dB stronger than the sound signal incident at 180°.

An exemplary embodiment of the present disclosure provides a microphone assembly which changes the acoustical distance of sound waves traveling to the rear acoustical input port of the microphone from one or more point sources, relative to a free field response in order to modify the directivity pattern of the microphone. The microphone assembly simultaneously optimizes the microphone response for maximum sensitivity in one direction, and minimizes the sensitivity in another direction, even if these directions are not 180 degrees apart. (In the case of the unmodified cardioid microphone free field response, the directions of the maximum and minimum sensitivity are separated by 180 degrees.)

Figure 4:
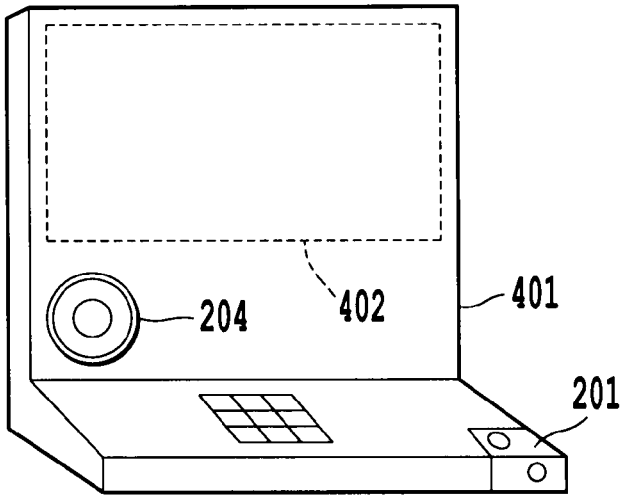
FIG. 4 is a perspective view of a terminal including a microphone assembly according to an exemplary embodiment of the present disclosure.

FIG. 4 is an exemplary embodiment of the present disclosure. The microphone 201 is mounted in a lower corner of a desktop telecommunication terminal 401, very close to the desktop surface, or table top. The microphone 201 is also mounted in the front of the terminal 401 in a mechanically controlled way to minimize comb filter effects. For example, minimizing comb filter effects is discussed in co-pending U.S. application Ser. No. 11/239,042 assigned to Tandberg Telecomm AS of Norway, the entire contents of which are incorporated herein by reference. The loudspeaker 204 is mounted on the opposite side of the terminal. Further, the exemplary loudspeaker 204 is preferably mounted on a surface located behind the microphone 201, in such a way that the distance between the near end user and loudspeaker 204 is longer than the distance between the near end user and the microphone 201. As can be seen in the figure, the maximum distance between the microphone 201 and the loudspeaker 204 in such a terminal 401 would be a diagonal separation.

Figure 5A:
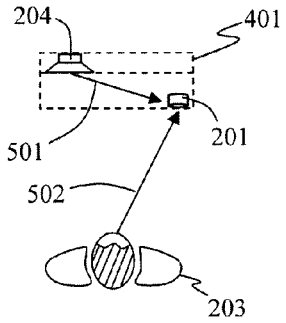
FIG. 5A is a schematic drawing of the incident angle of sound from a loudspeaker and a near end user.

FIG. 5A is a schematic drawing of the desktop communication terminal 401 in FIG. 4 and a near end user 203, from a top view perspective. If the microphone 201 had been mounted unobstructed in this position (free field), off center (and very low) on the desktop terminal 401, the incident angle 502 of the sound from a near end user 203 would be an area with reduced sensitivity for a cardioid microphone 201. Further, the incident angle 501 of sound from the loudspeaker 204 is in an area with significantly reduced sensitivity for a directional microphone 201, which again reduces feedback. However, in FIG. 5A, the separation between the loudspeaker sound direction 501 and the user-sound direction 502 is approximately 90 degrees, not the ideal 180 degree separation.

Figure 7A:
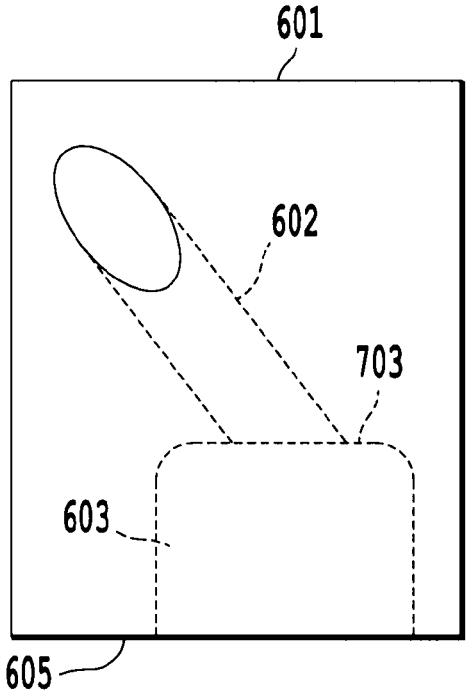
FIG. 7A is a top view of the microphone housing according to an exemplary embodiment of the present disclosure.
Figure 6A:
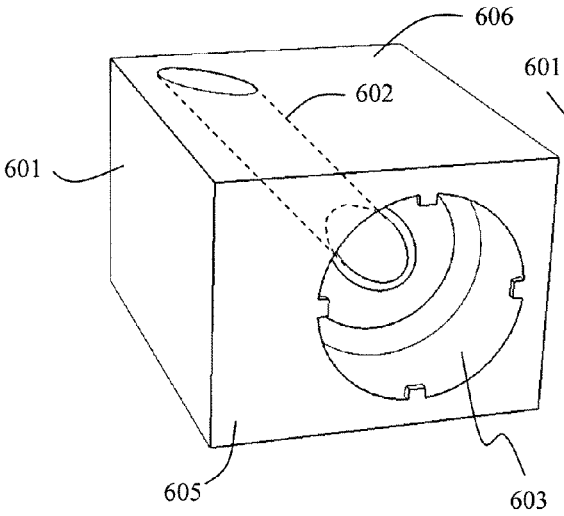
FIG. 6A is a schematic drawing of the microphone housing according to an exemplary embodiment of the present disclosure.
Figure 6B:
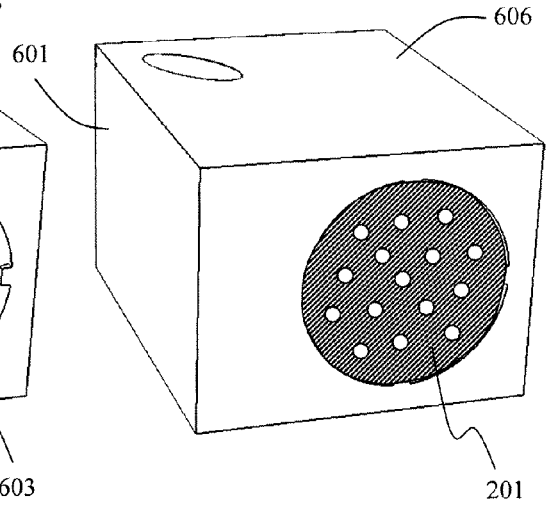
FIG. 6B is another schematic drawing of the microphone housing according to an exemplary embodiment of the present disclosure.

FIGS. 6 and 7 are schematic drawings of a housing 601 for a unidirectional microphone element 201 according to one exemplary embodiment of the present disclosure. The microphone 201 is encapsulated in a desktop base supporting the desktop system on the table as discussed above. The microphone housing 601 may be a separate part integrated in the desktop base, or the desktop base itself may serve as the microphone housing 601. Though shown in FIGS. 6 and 7 as a cube shape, the microphone housing (601) is not limited to a specific shape, and may, for example, be spherical, may have an octagonal cross-section, hexagonal cross-section, etc. An acoustic waveguide 602 extends from a first surface of the housing into a cavity 603 in the housing.

As indicated in FIGS. 6A, 6B, 7A and 7B the cavity 603 extends from a front surface 605 of the housing, hence creating an opening in the housing for receiving a directional microphone 201. The size and shape of the opening and cavity 603 should correspond to the size and shape of the microphone element. Alternatively, the size of the opening and cavity 603 may be slightly smaller than microphone element, to firmly hold the microphone 201 in position with the elastic properties of the housing material. Further, a slightly smaller cavity 603 also forms a seal around the sides of the microphone to prevent sound pressure at one acoustical input port from leaking to the other acoustical input port. The acoustical waveguide 602 directs sound waves from one or more point sources to reach the rear acoustical input port of the directional microphone.

The acoustical waveguide 602 extends from a top surface 606 of the housing 601 to a back surface 703 of the cavity 603. In another exemplary embodiment of the present disclosure, the channel is at an oblique angle both in azimuth and elevation relative to the central axis of the cavity 603 (said axis being parallel with the normal vector of the back surface). The acoustic waveguide 602 is angled towards the loudspeaker situated behind the microphone on the opposite side of the terminal. The length and direction of the acoustical waveguide 602 depend on the position of the loudspeaker relative to the microphone, and on a typical near end user 203 position relative to the microphone 201. As discussed below, the waveguide serves as a sound guide for sound from one or more sound sources to the rear acoustical input port of the microphone 201.

Though the acoustical waveguide 602 of FIG. 6 has a circular cross-section, other cross-sectional shapes are also within the scope of the invention as recognized by those skilled in the art. For example, the acoustical waveguide 602 may have a cross sectional shape of any one of a square, rectangle, trapezoid, oval, hexagon, octagon, and the like. Also, the acoustical waveguide 602 may be integrally molded into the microphone housing 601. Further, the acoustical waveguide 602 may also be curved or straight.

Figure 7B:
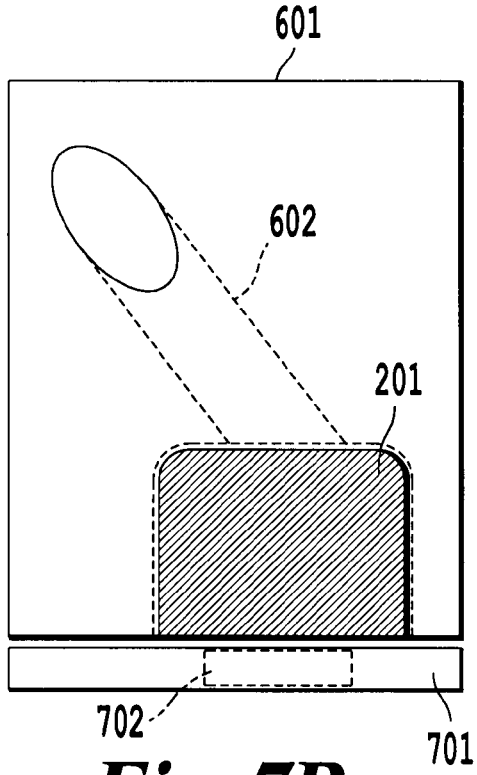
FIG. 7B is another top view of the microphone housing according to an exemplary embodiment of the present disclosure.

As shown in FIG. 7B a protective cover 701 may be placed at least in front of the microphone housing 601 to protect the microphone 201 from impacts and from falling out of the housing 601. One or more openings 702 are provided in the protective cover 701 to admit sound waves to the front acoustical input port of the microphone 201.

When the housing 601 with the microphone 201 is mounted in a desktop system 401 the front acoustical input port of the microphone 201 faces away from the system. According to one exemplary embodiment of the disclosure, the front acoustical input port faces forward, in the general direction of the near end user. However, the microphone may also be tilted slightly towards the desktop (or table surface). The acoustical waveguide 602 for guiding sound to the rear acoustical input port is designed to simultaneously minimize the microphone sensitivity in the direction of the internal loudspeaker, and maximize the microphone sensitivity in the direction of the user. This is achieved by making the acoustical waveguide's 602 length dimension much larger than its diameter, and slightly angling the waveguide in the direction of the loudspeaker 204 to approximate a free field response. Thus, sound from the loudspeaker 204 arrives at the rear input port of the microphone before arriving at the front input port of the microphone, reducing the microphone's sensitivity to sound from the loudspeaker. Further, the additional distance the sound from the loudspeaker needs to travel to traverse the corners of the microphone housing and the protective cover increases the relative delay between the loudspeaker sound reaching the rear and the front acoustical input ports of the directional microphone, further decreasing sensitivity to loudspeaker sound.

Figure 5B:
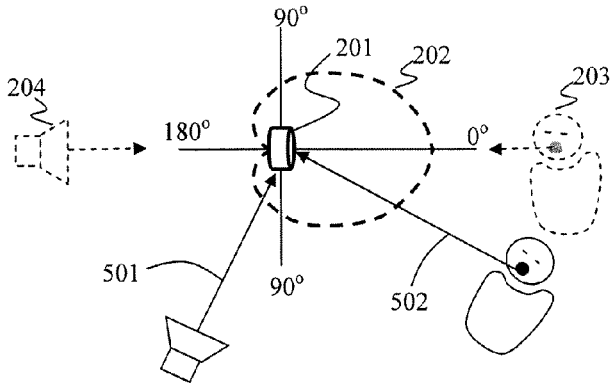
FIG. 5B is another schematic drawing of the incident angle of sound from a loudspeaker and a near end user.

Sensitivity is, however, enhanced with respect to the near end user. The acoustical waveguide 602 is angled in the direction of the loudspeaker, and simultaneously angled away from the near end user. The length and direction of the acoustical waveguide increase the acoustic distance between the near end user and the rear acoustical input port, relative to a free field acoustical distance. Sound from the near end user arrives at the front input port of the microphone without delay, while arriving at the rear input port of the microphone with delay, due to the configuration of the acoustical waveguide. The length and direction of the acoustical waveguide 602 increases the relative delay between sound reaching the rear of the unidirectional microphone and sound reaching the front of the unidirectional microphone, increasing the sensitivity of the microphone for sound coming from the user (speech). In other words, the increased delay experienced by the microphone "moves" the direction of sound closer to 0° as illustrated by arrow 503 in FIG. 5B, leading to a high sensitivity for sound from the user.

Figure 8:
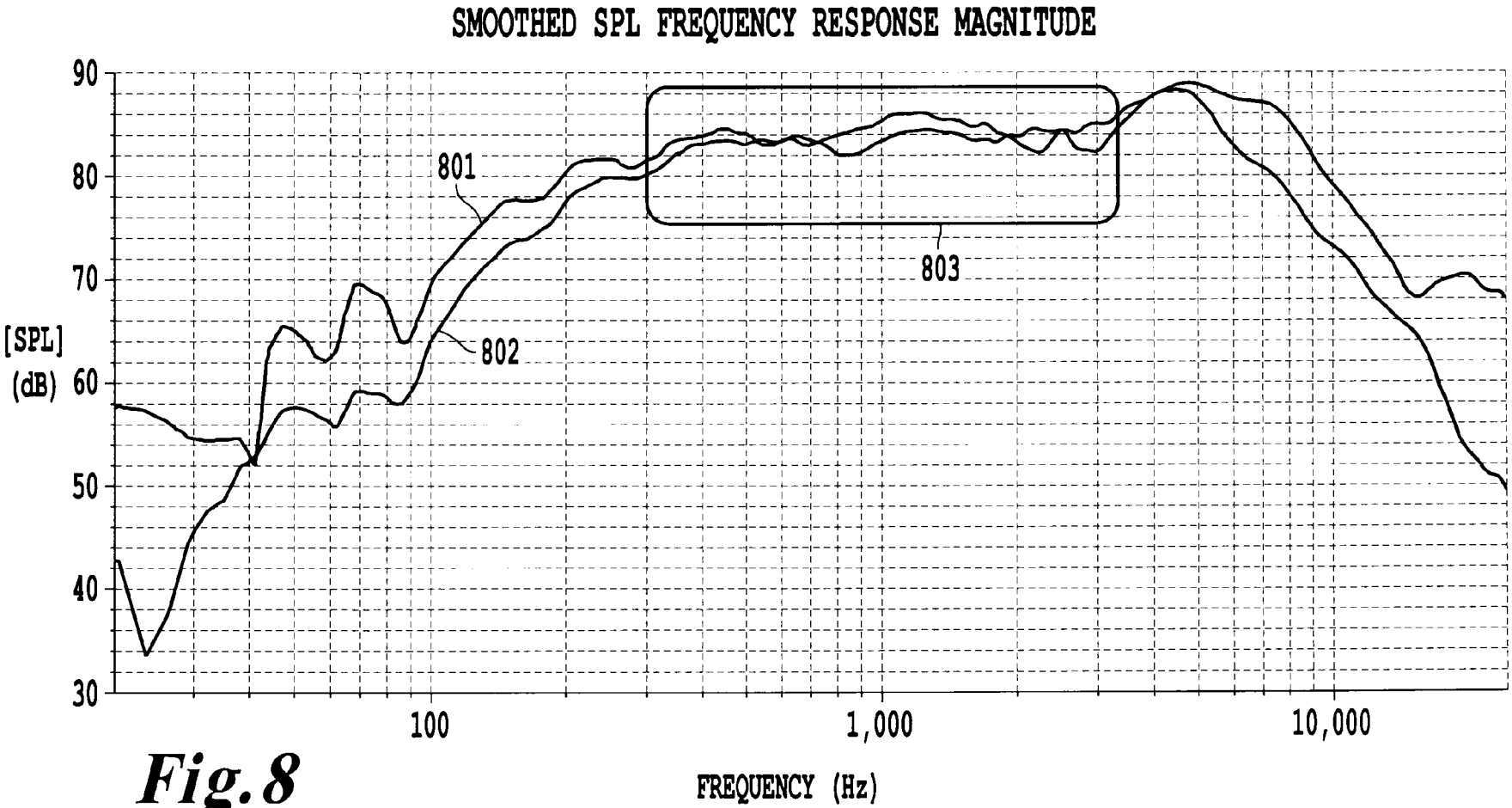
FIG. 8 is two (an omni directional and a unidirectional) microphone responses from a typical user position with the microphone assembly according to an exemplary embodiment of the present disclosure.

FIG. 8 is an example of achieved microphone response from a typical user position with the microphone assembly according to one exemplary embodiment of the present disclosure. The response 802 is of a calibrated unidirectional microphone mounted in the above described housing. The response 801 is of a calibrated omni directional reference microphone in the same position, and is shown as a reference. The response 802 approximates the response of an omni directional microphone, particularly in the center of the voice frequency band 803.

Figure 9:
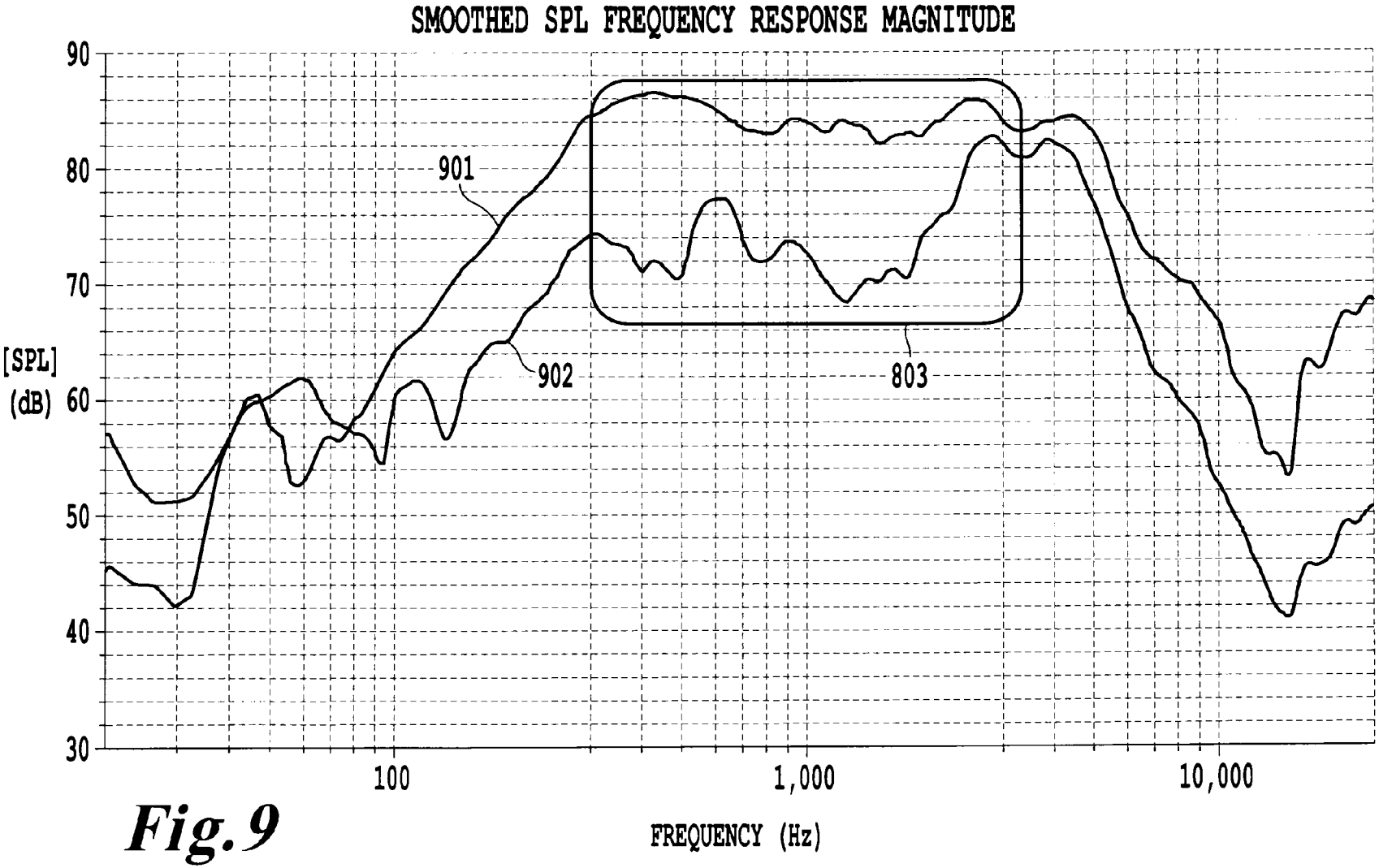
FIG. 9 is a feedback response from internal loudspeaker to a calibrated unidirectional and omni directional microphone with the microphone assembly according to an exemplary embodiment of the present disclosure.

FIG. 9 is a feedback response 902 from internal loudspeaker to a calibrated unidirectional microphone, and the feedback response 901 of a calibrated omni directional microphone in the same position. A reduction in feedback up to 16 dB is achieved by the present disclosure for most frequencies in the voice frequency band 803.

The length of the channel guiding sound to the rear acoustical input port of the microphone causes the frequency response and directional properties to differ from the free field case. The long channel causes a narrower frequency range of directional behavior. FIGS. 8 and 9 show that a good directional behavior is achieved up to 2 kHz. In telephony, however, the usable voice frequency band 803 ranges from approximately 300 Hz to 3400 Hz. Therefore, the directional behavior achieved by the present disclosure is suitable at least for telephony.

In another exemplary embodiment, mechanical protection of the microphone element is secured in a sturdy, rugged housing made out of a relatively hard rubber material.

The cavity 603 for housing the microphone element should encapsulate the microphone element. A gap between the rear of the microphone 201 and the back surface 703 of the cavity 603, together with the acoustical waveguide, may create a resonant system with a resonance peak at a resonance frequency within the frequency response. To control the resonance of the cavity, the distance between the microphone and the back surface should be minimized to move the resonance frequency as to a high frequency outside the voice frequency band 803. The distance between the back surface of the microphone housing and the microphone may be minimized by controlling the dimensions of the microphone housing, or by inserting an insert into the cavity between the rear surface and the microphone, and the like. Further, the diameter of the sound guide should be wide enough to minimize the low resonance peak. This will ensure a proper frequency response and directional behavior.

Alternatively, the resonance peak may also be attenuated using a filter, such as a digital filter or an analog filter. Further the filter may also be used to equalize the frequency response of the system to a predetermined response characteristic. For example, the filter may be designed to produce a maximally flat frequency response in the range of 300 Hz to 3400 Hz.

Structure-borne noise and vibrations from, for example, the tabletop surface on which the terminal is placed, can result from bumping or knocking the table. To minimize pickup of such sounds and vibrations from the terminal assembly or the table surface, the microphone housing 601 is preferably made of a vibration damping material. The material of the housing 601 should be quite hard for rigidity and protection, yet somewhat elastic to withstand varying stresses from the terminal 401 above it. Further, the material should also hold the microphone 201 in a fixed position, as described above. The housing 601 should be able to temporarily carry the weight of the whole terminal 401 without damage or deformation to acoustic waveguide 602. The material should be nonporous to minimize sound absorption. Suitable materials include, for example, an elastomer cast with hardness of at least shore 35.

The microphone housing 601 can be designed to be used as a base on which the desktop system rests. This significantly reduces the degree of integration, thereby making an independent microphone module that can easily be reused in new systems. In this context a "base" is a portion of the video conferencing terminal that is in contact with the surface upon which the terminal rests, such as a table, and may be integrally formed with the terminal or may be detachable from the terminal.

When the above aspects are considered, the following practical dimensions could be used according to one exemplary embodiment of the present disclosure: A acoustical waveguide width in the range of 1-4 mm, which matches sound entry holes in a typical unidirectional electret microphone element, a waveguide length in the range of 10-20 mm, and a protective cover thickness in the range of 0.5-5 mm.

Further, when used as a base for a system, the housing 601 also includes a cable guiding structure to position and thread signal cable from the microphone to the rest of the electronics in the system.

Any microphone element requiring sound wave entry from two directions could be used. A typical choice is a unidirectional cardioid electret condenser microphone of any size.

A benefit of the present disclosure is that the housing minimizes feedback from loudspeaker to microphone, while simultaneously maximizing microphone sensitivity to the user for a unidirectional microphone element, while keeping the microphone protected. The present disclosure also increases sound quality for full audio band sound pickup with only one acoustic waveguide tuned to optimize the directivity pattern of the microphone element and simultaneously minimize feedback.

Obviously, numerous modifications and variations of the present invention are possible in light of the above teachings. It is therefore to be understood that within the scope of the appended claims, the invention may be practiced otherwise than as specifically described herein.

The invention claimed is:

1. A desktop telecommunication terminal comprising:

a loudspeaker;

a directional microphone including a front acoustical input port and a rear acoustical input port;

a housing provided for encapsulating the directional microphone;

an acoustic waveguide disposed in the housing to extend from the rear acoustical port of the microphone to a waveguide inlet on an upper surface of the telecommunication terminal, a length and a direction of the waveguide being tuned to reduce an acoustic distance between the loudspeaker and the rear acoustical input port of the microphone, approximating a free field acoustic distance, and the length and direction of the waveguide also being tuned to increase an acoustic distance between the rear acoustical input port and a sound source relative to the free field acoustic distance; and a facing surface configured to admit sound to the front acoustical input port of the microphone, the facing surface having at least one opening.

2. The desktop telecommunication terminal according to claim 1, wherein the waveguide is simultaneously angled toward the loudspeaker and away from the sound source.

3. The desktop telecommunication terminal according to claim 1, wherein a distance between the sound source and the directional microphone is shorter than a distance between the sound source and the loudspeaker.

4. The desktop telecommunication terminal according to claim 1, wherein the microphone is mounted on a lower corner of the telecommunication terminal and the loudspeaker is positioned on a vertical half of the telecommunication terminal, opposite the microphone.

5. The desktop telecommunication terminal according to claim 1, wherein the housing is a base of the desktop telecommunication terminal.

6. The desktop telecommunication terminal according to claim 1, wherein the acoustic waveguide has a circular cross-section, a diameter of the circular cross-section being smaller than a length of the acoustic waveguide.

7. The desktop telecommunication terminal according to claim 1, wherein a distance between the rear acoustical input port of the microphone and a rear side of the housing is tuned to increase a resonant frequency beyond a voice frequency band.

8. The desktop telecommunication terminal according to claim 1, wherein the housing is made of an elastomer having a hardness of at least shore 35.

9. The desktop telecommunication terminal according to claim 1, wherein the housing includes a cable guide provided to guide a cable from the directional microphone to the desktop telecommunication terminal.

10. A microphone assembly comprising:

a directional microphone including a front acoustical input port and a rear acoustical input port;

a housing provided to encapsulate the directional microphone;

a single acoustic waveguide arranged diagonally within the housing, the acoustic waveguide having one end positioned near the rear acoustical port of the microphone and one end positioned on an upper surface of the housing.

11. The microphone assembly according to claim 10, wherein the acoustic waveguide has a circular cross-section, a diameter of the circular cross-section being smaller than a length of the acoustic waveguide.

12. The microphone assembly according to claim 10, wherein a distance between the rear acoustical input port of the microphone and a rear side of the housing is tuned to increase a resonant frequency beyond a voice frequency band.

13. The microphone assembly according to claim 10, wherein the housing is made of an elastomer having a hardness of at least shore 35.

14. The microphone assembly according to claim 10, wherein the housing includes a cable guide provided to guide a cable from the directional microphone to a desktop telecommunication terminal to which the housing is attached.

15. An acoustic echo reducing apparatus comprising:

means for positioning a directional microphone;

means for decreasing an acoustic distance between a loudspeaker and a rear acoustic port of the directional microphone;

means for increasing an acoustic distance between a sound source and a rear acoustical port of the directional microphone;

means for increasing a resonant frequency beyond a voice frequency band; and means for reducing a resonant peak.

* * * * *